US009576765B2

(12) United States Patent
Bakhtari

(10) Patent No.: US 9,576,765 B2
(45) Date of Patent: Feb. 21, 2017

(54) ELECTRON BEAM EMITTER WITH INCREASED ELECTRON TRANSMISSION EFFICIENCY

(71) Applicant: Kaveh Bakhtari, Osaka (JP)

(72) Inventor: Kaveh Bakhtari, Osaka (JP)

(73) Assignee: Hitachi Zosen Corporation, Osaka (JP)

( * ) Notice: Subject to any disclaimer, the term of this patent is extended or adjusted under 35 U.S.C. 154(b) by 0 days.

(21) Appl. No.: 14/488,862

(22) Filed: Sep. 17, 2014

(65) Prior Publication Data

US 2016/0079028 A1 Mar. 17, 2016

(51) Int. Cl.
*H01J 33/04* (2006.01)
*H01J 1/16* (2006.01)
*H01J 33/00* (2006.01)

(52) U.S. Cl.
CPC ..... *H01J 33/04* (2013.01); *H01J 1/16* (2013.01); *H01J 33/00* (2013.01)

(58) Field of Classification Search
USPC ..... 250/493.1
See application file for complete search history.

(56) References Cited

U.S. PATENT DOCUMENTS 3,967,150 A 6/1976 Lien et al.
4,499,405 A 2/1985 Loda
4,873,468 A 10/1989 Miram et al.
5,612,588 A * 3/1997 Wakalopulos ..... B29C 71/04 313/35
7,795,792 B2 * 9/2010 Arnold ..... H01J 35/06 313/271
8,339,024 B2 12/2012 Walther et al.
2002/0135290 A1 * 9/2002 Avnery ..... H01J 33/04 313/420
2004/0183032 A1 9/2004 Fink et al.
2007/0278928 A1 12/2007 Lee et al.

OTHER PUBLICATIONS

Isr in PCT/JP2015/002321 dated Jul. 30, 2015.

* cited by examiner

*Primary Examiner* — Phillip A Johnston
(74) *Attorney, Agent, or Firm* — Fildes & Outland, P.C.

(57) ABSTRACT

An electron beam emitter comprises an electron emission source capable of emitting electrons; a vacuum chamber containing the electron emission source; and a transmission window that keeps airtightness of the vacuum chamber and is capable of transmitting the electrons from the electron emission source. The transmission window includes a foil that transmits the electrons and a grid that does not transmit the electrons. The electron emission source includes an emission portion that emits the electrons and a non-emission portion that does not emit the electrons. The emission portion has a lower work function than the non-emission portion. The non-emission portion is prepared so as to prevent the electrons from reaching the grid.

12 Claims, 5 Drawing Sheets

ELECTRON BEAM EMITTER WITH INCREASED ELECTRON TRANSMISSION EFFICIENCY

FIELD OF THE INVENTION

The present invention relates to an electron beam emitter with increased electron transmission efficiency by en electron emission source having both high work function and low work function surfaces, creating emission trajectories that are matched to the transmission pattern of the e-beam window.

BACKGROUND OF THE INVENTION

Conventionally, an electron beam emitter includes an electron emission source that can emit electrons and a vacuum chamber that contains the electron emission source. The vacuum chamber has a transmission window that can transmit electrons. The transmission window includes foil that transmits electrons and a grid that supports the foil. The grid rises in temperature as it completely absorbs electrons from the electron emission source. Thus, a cooling mechanism is provided on the periphery of the transmission window to remove the excess energy and keep the grid at an acceptable operating temperature. In summary, the electron beam emitter accelerates electrons, which are emitted from the electron emission source, in the vacuum chamber and passes the accelerated electrons through the foil of the transmission window (the e-beam window) so as to emit electron beams to the outside (atmospheric side) of the vacuum chamber.

Generally, in a typical electron beam emitter shown in FIG. 6, foil 12 absorbs a small proportion of electrons $e^-$ of electron beams 14 having reached the foil 12 and transmits the other proportion of electrons $e^-$, whereas a grid 10 absorbs all the electrons $e^-$ of electron beams 14 having reached the grid 10(10*b*). The absorption of electrons $e^-$ into the transmission window 9 increases the temperatures of the grid 10 as well as the foil 12.

As the electron $e^-$ exposed surface of the grid 10*b* is comparable to the electron $e^-$ exposed surface of the foil 10*a*, the fractional foil 12 absorption versus full absorption at the grid 10 leads to low transmission efficiency of electrons $e^-$ in prior art designs.

An objective of the present invention is to provide an electron beam emitter that has high electron transmission efficiency that allows for either (1) low temperature operation of the transmission window at the same output (high reliability and increased life) or (2) increased current density and higher output at the same operating temperature.

There are prior patents (e.g., U.S. Pat. No. 8,339,024) that achieve this goal by intercepting the waste beam with an additional structure, however, these concepts will result in internal high temperatures that would create undesired outgassing and additional thermal management requirements. The novelty of this invention is in eliminating the waste portion of the beam at the source and providing the most efficient solution.

DISCLOSURE OF THE INVENTION

In order to attain the objective, this invention is an electron beam emitter comprising: an electron emission source capable of emitting electrons; a vacuum chamber containing the electron emission source; and a transmission window that keeps airtightness of the vacuum chamber and is capable of transmitting the electrons from the electron emission source, the transmission window including a transmission portion that transmits the electrons and a non-transmission portion that blocks the electrons, the electron emission source including an emission portion that emits the electrons and a non-emission portion that does not emit the electrons, the emission portion having a lower work function than the non-emission portion, the non-emission portion being prepared so as to prevent the electrons from reaching the non-transmission portion.

With this configuration, the electron beam emitter can increase electron transmission efficiency allowing either low temperature operations or high current density output within the limits of the system.

DESCRIPTION OF THE EMBODIMENTS

[First Embodiment]

An electron beam emitter according to a first embodiment of the present invention will be described below with reference to the accompanying drawings.

Figure 1:
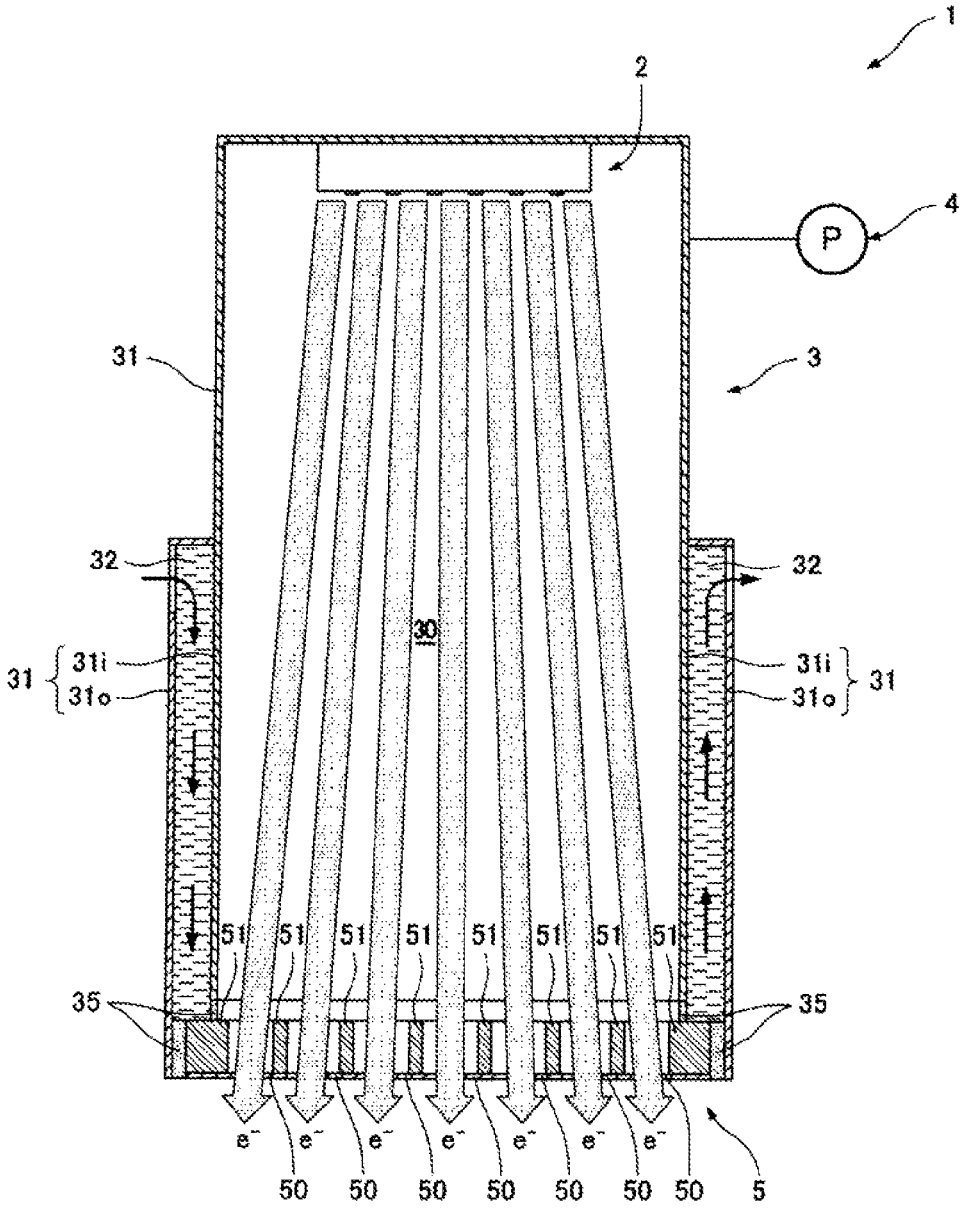
FIG. 1 is a schematic cross-sectional view showing an electron beam emitter according to a first embodiment of the present invention.
Figure 2:
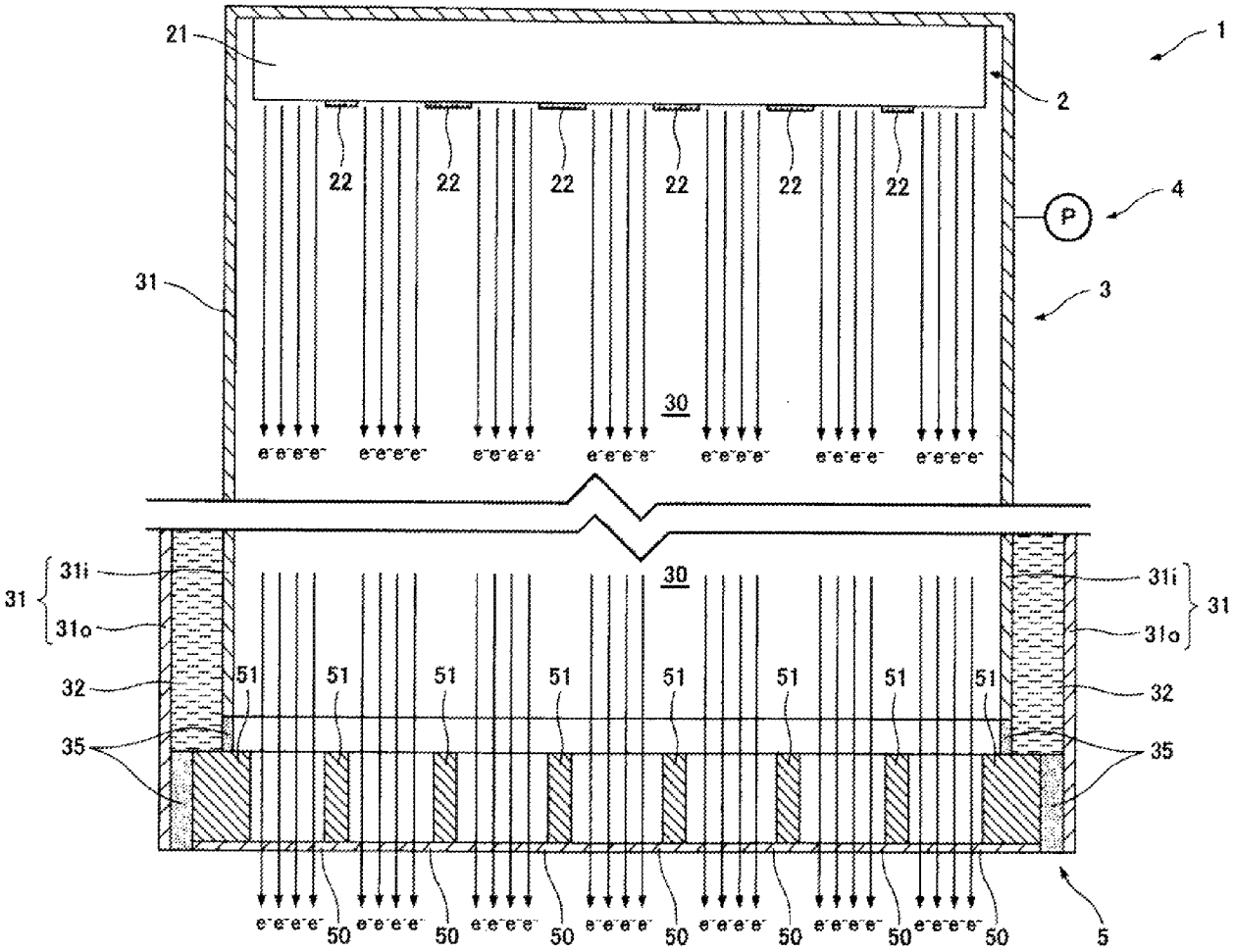
FIG. 2 is an enlarged cross-sectional view showing a principal part of the electron beam emitter according to the first embodiment of the present invention.

As shown in FIGS. 1 and 2, an electron beam emitter 1 includes an electron emission source 2 that can emit electrons $e^-$ and a vacuum chamber 3 that contains the electron emission source 2 in an interior 30. The vacuum chamber 3 is connected to a vacuum pump 4 (may be detachable) that creates a vacuum in the interior 30. Furthermore, the vacuum chamber 3 has a transmission window 5 that can transmit the electrons $e^-$ from the electron emission source 2. The transmission window 5 keeps airtightness in the vacuum chamber 3 along with walls 31 that constitute the vacuum chamber 3. In the vacuum chamber 3, the walls 31 on a part connected to the transmission window 5 have a double wall construction: an inner shell 31*i* and an outer shell 31*o*. In this construction, the inner shell 31*i* is connected to the edge of the upper face (a surface near the electron emission source 2) of the transmission window 5 while the outer shell 31*o* is connected to the lower end of the side of the transmission window 5. A space between the inner shell 31*i* and the outer shell 31*o* circulates a coolant 32. The inner shell 31*i* and the edge of the transmission window 5 are connected to each other by methods including but not limited to brazing 35. The outer shell 31*o* and the lower end of the side of the transmission window 5 are connected to each other by methods including but not limited to brazing 35. The inner shell 31*i*, the outer shell 31*o*, and the coolant 32 constitute a cooling unit.

The transmission window 5 will be described below.

As shown in FIGS. 1 and 2, the transmission window 5 includes foil 50 (an example of a transmission portion) that transmits the electrons $e^-$ and a grid 51 (an example of a non-transmission portion) that supports the foil 50 from the pressure gradient as well as it provides a conductive path for heat removal. The foil 50 absorbs a small proportion of electrons $e^-$ reaching the foil 50 and transmits the other proportion of electrons $e^-$. The foil 50 is, for example, a titanium film having a thickness on the order of micrometers. The grid 51 has significantly larger thickness than the foil 50 so as to act as a reinforcing member of the transmission window 5. Thus, the grid 51 cannot transmit electrons $e^-$. This causes the grid 51 to absorb all electrons $e^-$ reaching the grid 51, leading to lower transmission efficiency of electrons $e^-$ and a temperature rise of the transmission window 5. Hence, the electron emission source 2 is configured such that emitted electrons $e^-$ reach only as far as the foil 50 without reaching the grid 51. This configuration will be specifically described below. For efficient transmission of heat from the transmission window 5 to the cooling unit, the grid 51 is made of a material having a high thermal conductivity, for example, copper. The grid 51 further undergoes a joining process 35 such as brazing.

The electron emission source 2, that is, the essence of the present invention, is specifically described below.

As shown in FIG. 2, the electron emission source 2 includes a cathode 21 connected to a power supply (not shown) and a layer part 22 deposited at least on the emitting surface (a surface near the transmission window 5) of the cathode 21. The cathode 21 has a lower work function than the deposited layer part 22. In other words, a material having a higher work function than that of the cathode 21 is prepared as the layer part 22 on the cathode 21. Thus, on the emitting surface of the cathode 21, portions not covered with the layer part 22 serve as emission portions for emitting electrons $e^-$, whereas portions covered with the layer part 22 serve as non-emission portions that do not emit electrons $e^-$. The layout of the layer part 22 is designed such that electrons $e^-$ emitted from the emitting surface of the cathode 21 reach only as far as the foil 50 without reaching the grid 51.

A specific configuration of the electron emission source 2 will be described below.

Figure 3:
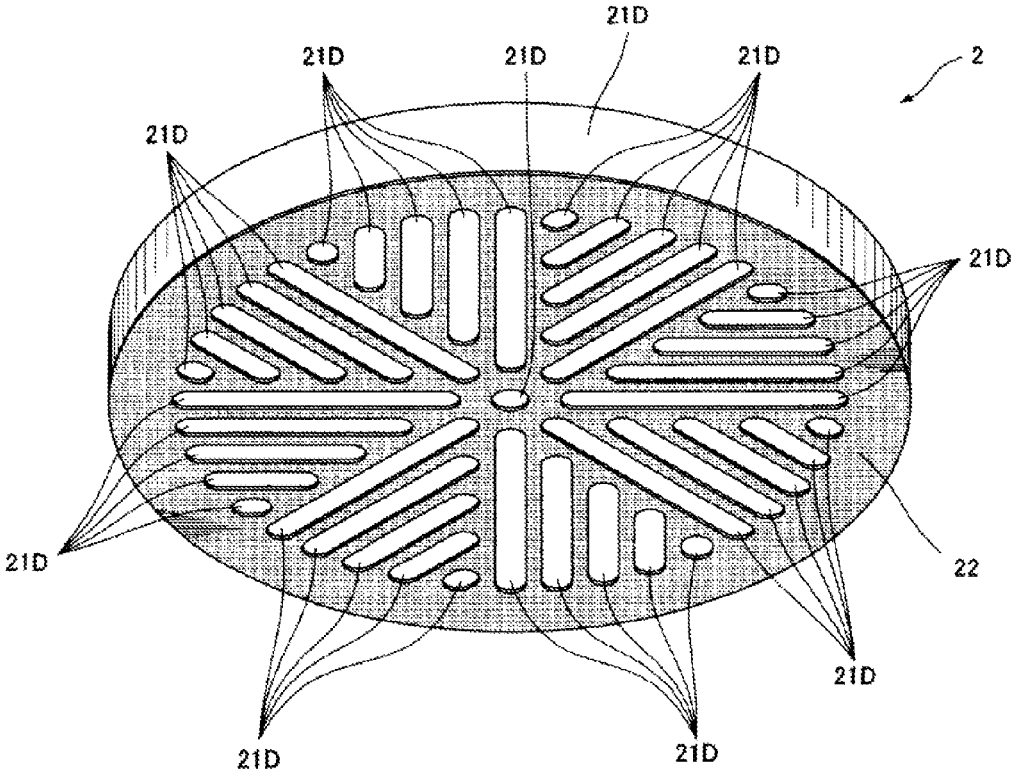
FIG. 3 is a schematic perspective view showing a cathode in the electron beam emitter according to the first embodiment of the present invention.
Figure 4:
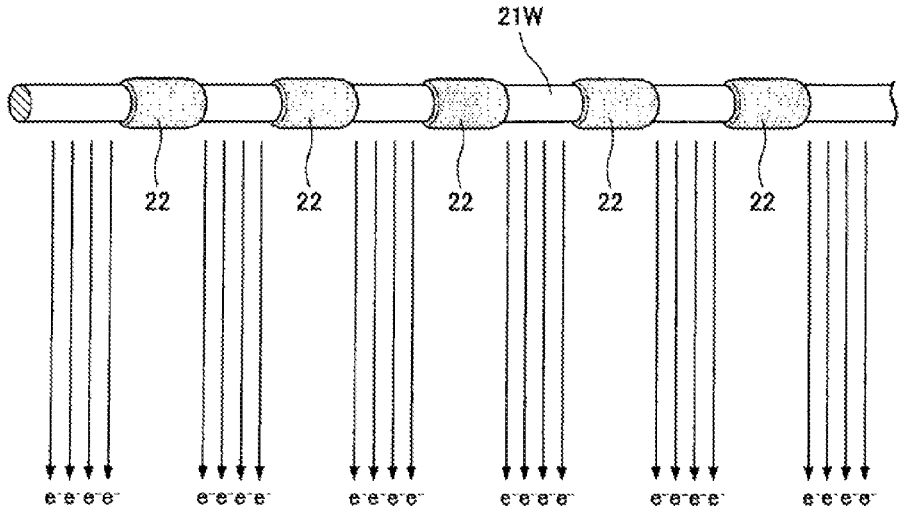
FIG. 4 is a schematic perspective view showing a cathode in an electron beam emitter according to a second embodiment of the present invention.

The cathode 21 of the electron emission source 2 may be a disc-type cathode (hereinafter, will be called a disc cathode 21D) shown in FIG. 3 or a wire-type cathode (hereinafter, will be called a wire cathode 21W) shown in FIG. 4. One of the two circular surfaces of the disc cathode 21D is prepared as the emitting surface (the surface near the transmission window 5). The electron beam emitter 1 including the disc cathode 21D as the cathode 21 has the noticeable disc-shaped transmission window 5 and thus is suitable for electron beam processing equipment (such as inner container sterilization equipment) for emitting electron beams to a circular subject or into a cylinder. The electron beam emitter 1 including the wire cathode 21W as the cathode 21 has the rectangular transmission window 5 and thus is suitable for electron beam processing equipment (such as outer container sterilization equipment or material surface modification) for emitting electron beams to a subject from the outside.

For the layout of the layer part 22 on the cathode 21, for example, patterning is selected from (1) to (4):

(1) CVD or PECVD With a Mask

The cathode 21 covered with a mask is subjected to CVD or PECVD (Plasma-Enhanced CVD) using the material of the layer part 22. The material is not deposited an portions covered with the mask and thus the portions serve as the emission portions. The material forms the layer part 22 on portions not covered with the mask, the portions serving as the non-emission portions.

(2) Etching After Vapor Deposition

The cathode 21 is deposited with the material of the layer part 22. After that, on a film formed by vapor deposition, portions corresponding to the emission portions are removed by etching so as to expose the cathode 21. Thus, the portions corresponding to the exposed cathode 21 serve as the emission portions, whereas the unremoved portions of the film serve as the non-emission portions.

(3) Mechanical Removal After Coating

The cathode 21 is coated with the material of the layer part 22. After that, on a film formed by coating, portions corresponding to the emission portions are removed by mechanical scraping so as to expose the cathode 21. Thus, the portions corresponding to the exposed cathode 21 serve as the emission portions, whereas the unremoved portions of the film serve as the non-emission portions.

(4) Spray Coating With a Mask

The cathode 21 is covered with a mask and then undergoes spray coating with the material of the layer part 22. Portions covered with the mask are not deposited with the material and thus serve as the emission portions, whereas the material forms the layer part 22 on portions not covered with the mask, the portions serving as the non-emission portions.

For example, the cathode 21 and the layer part 22 are made of the following materials: if the cathode 21 is composed of crystals of Hafnium Carbide (HfC) or Lanthanum Hexa-Boride (LaB6), the layer part 22 is made of pyrolytic graphite. The crystal of Hafnium Carbide or Lanthanum Hexa-Boride has a lower work function than pyrolytic graphite.

For example, the layout of the layer part 22 is designed as follows:

First, the trajectories of electrons $e^-$ emitted from the single cathode 21 are simulated. Subsequently, the electrons $e^-$ with the simulated trajectories are tracked after being categorized into the electrons $e^-$ reaching the foil 50 of the transmission window 5 and the electrons $e^-$ reaching the grid 51 of the transmission window 5. According to the tracking, the cathode 21 is categorized into portions for emitting the electrons $e^-$ reaching the foil 50 (hereinafter, will be called indispensable portions) and portions for emitting the electrons $e^-$ reaching the grid 51 (hereinafter, will be called dispensable portions). These steps are repeated to increase the accuracy of categorization. The layer part 22 is located on the dispensable portions. The layout of the layer part 22 does not need to completely match with the dispensable portions as long as the layout contains all the dispensable portions.

The effects of the electron beam emitter 1 will be discussed below.

When a proper voltage is applied from the power supply to the cathode 21 of the electron emission source 2, as shown in FIGS. 1 and 2, electrons $e^-$ are emitted from the portions where the layer part 22 is not deposited on the emitting surface of the cathode 21, whereas electrons $e^-$ are not emitted from the portions where the layer part 22 is deposited. The emitted electrons $e^-$ reach only as far as the foil 50 without reaching the grid 51. The foil 50 absorbs a small proportion of electrons $e^-$ reaching the foil 50 and transmits the other proportion of electrons $e^-$. Electrons $e^-$ transmitted through the foil 50 are scattered into an electron beam plume that is emitted on the atmospheric side of the transmission window 5.

Thus, according to the electron beam emitter 1, all electrons $e^-$ emitted from the electron emission source 2 reach the foil 50, thereby increasing the transmission efficiency of electrons $e^-$.

Moreover, according to the electron beam emitter 1, electrons $e^-$ emitted from the electron emission source 2 do not reach the grid 51, thereby suppressing a temperature rise of the transmission window 5.

Due to higher transmission efficiency of electrons $e^-$ and suppression of a temperature rise of the transmission window 5, the configuration of the cooling unit is simplified more than a conventional device with the same maximum irradiation amount of electron beams.

Furthermore, due to higher transmission efficiency of electrons $e^-$ and suppression of a temperature rise of the transmission window 5, the maximum irradiation amount of electron beams is larger than that of the conventional device including the cooling unit with an identical configuration.

In the first embodiment, the specific materials of the cathode 21 and the layer part 22 were described. The materials are not particularly limited. The cathode 21 may be made of any material as long as the material has a lower work function than the material of the layer part 22. In other words, the layer part 22 may be made of any material as long as the material has a higher work function than the material of the cathode 21.

[Second Embodiment]

Figure 5:
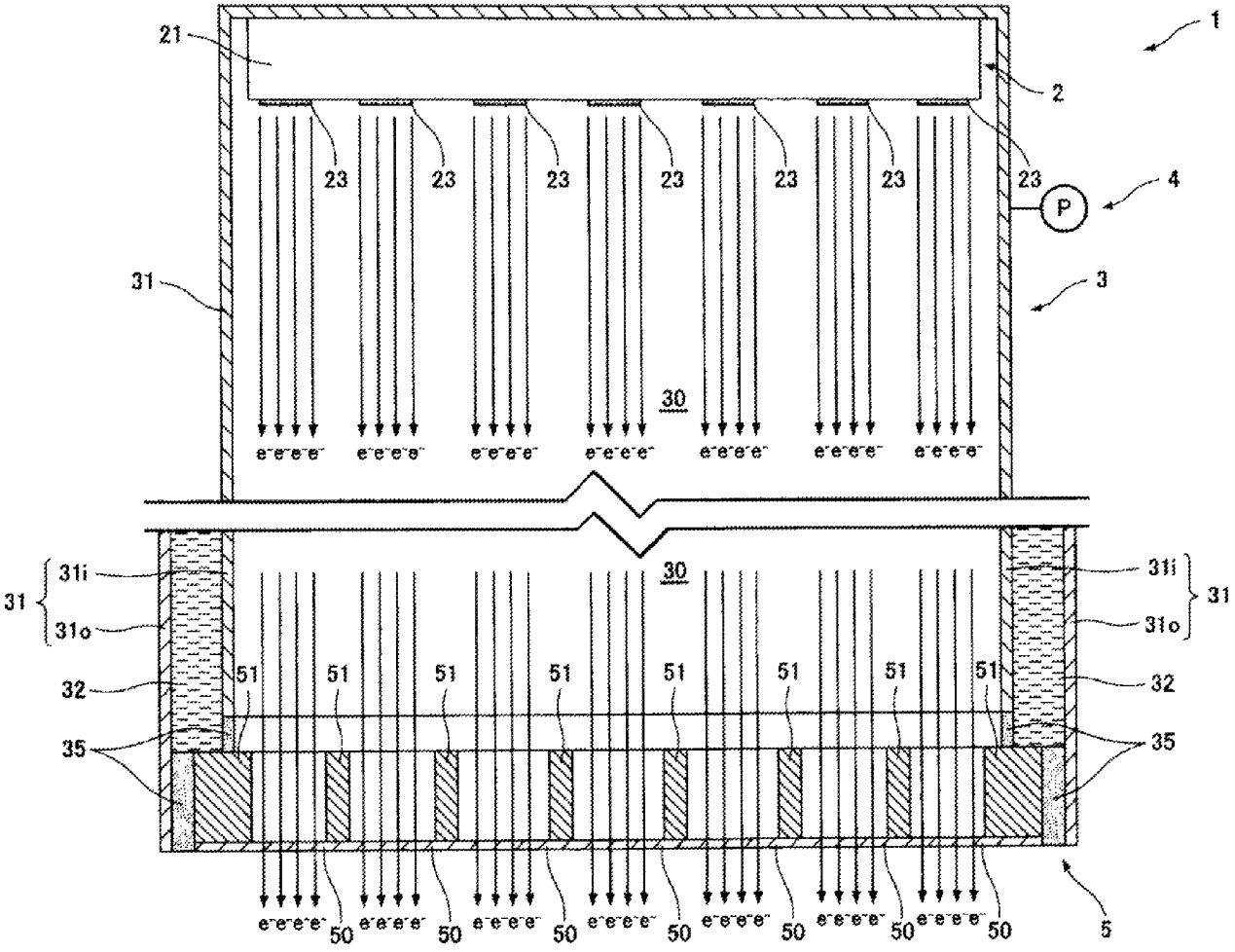
FIG. 5 is an enlarged cross-sectional view showing a principal part of an electron beam emitter according to a second embodiment of the present invention.
Figure 6:
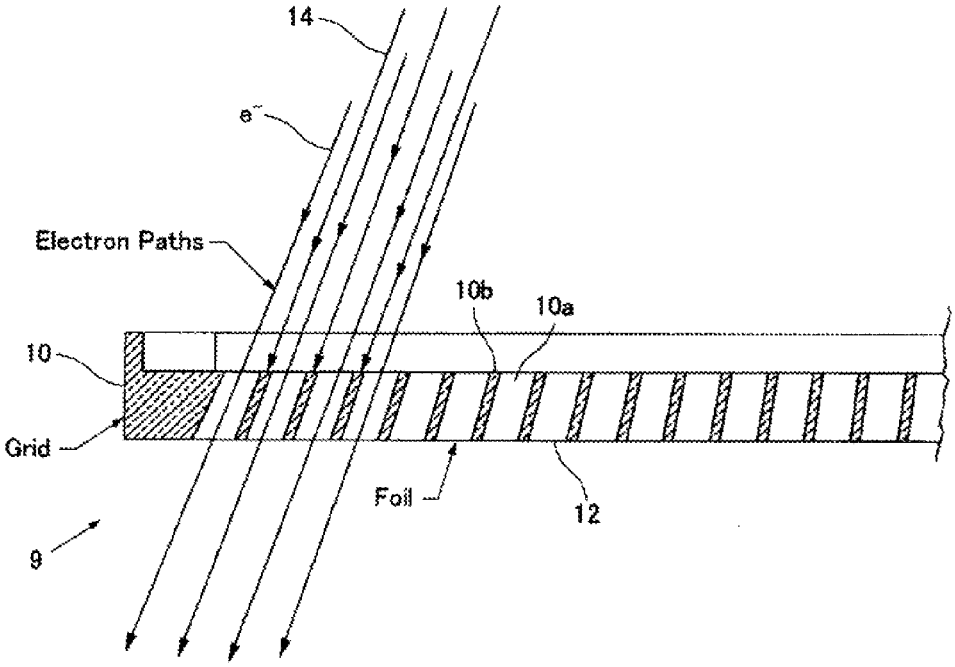
FIG. 6 PRIOR ART
FIG. 6 is a schematic cross-sectional view showing a transmission window in a conventional electron beam emitter.

As shown in FIG. 5, in an electron beam emitter 1 according to a second embodiment of the present invention, the relationship between an emission portion/non-emission portion and a portion having a layer part 23/other portions on the emitting surface of a cathode 21 is reversed from that of the first embodiment.

Differences from the first embodiment will be mainly described below. The same configurations as those of the first embodiment will be indicated by the reference numerals and the explanation thereof is omitted.

The cathode 21 according to the second embodiment of the present invention has a higher work function than the layer part 23. In other words, a material having a lower work function than the cathode 21 is deposited as the layer part 23 on the cathode 21. Thus, on the emitting surface of the cathode 21, portions having the layer part 23 serve as emission portions for emitting electrons $e^-$ while portions not having the layer part 23 serve as non-emission portions that do not emit electrons $e^-$. The layout of the layer part 23 is designed such that emitted electrons $e^-$ reach only as far as the foil 50 without reaching a grid 51.

For example, the cathode 21 and the layer part 23 according to the second embodiment of the present invention are made of the following materials: if a disc cathode 21D is made of Iridium (Ir) or a wire cathode 21W is made of Tungsten (W), the layer part 23 is made of Barium Oxide (BaO). Naturally, iridium or Tungsten has a higher work function than Barium Oxide.

Also in the electron beam emitter 1 according to the second embodiment of the present invention, emitted electrons $e^-$ reach only as far as the foil 50 without reaching the grid 51. Thus, the electron beam emitter 1 according to the second embodiment of the present invention has the same effect as the electron beam emitter 1 according to the first embodiment.

In the second embodiment, the specific materials of the cathode 21 and the layer part 23 were described. The materials are not particularly limited. The cathode 21 may be made of any material, as long as the material has a higher work function than the material of the layer part 23. In other words, the layer part 23 may be made of any material as long as the material has a lower work function than the material of the cathode 21.

In the first and second embodiments, the disc cathode 21D and the wire cathode 21W were described as examples of the cathode 21. The cathode 21 is not particularly limited as long as the non-emission portions are deposited such that electrons $e^-$ do not reach the grid 51.

The vacuum pump 4 connected to the vacuum chamber 3 in the first and second embodiments may not be connected to the vacuum chamber 3.

In the first and second embodiments, the coolant 32 is used for the cooling unit. The coolant 32 may be replaced with cooling air, that is, the cooling unit may be an air-cooled unit. In the case of an air-cooled unit, cooling air may be caused to impinge on the overall transmission window 5 or only the foil 50.

In the first and second embodiments, the transmission window 5 includes the foil 50 and the grid 51. The transmission window 5 is not limited to this configuration as long as the transmission window 5 has a transmission portion that transmits electrons and a non-transmission portion that does not transmit electrons. The transmission window may be formed by patterning a material (e.g., etching a pattern on a Silicon disk) with a certain thickness so as to have recessed portions. In this case, the recessed portions serve as transmission portions while other portions serve as non-transmission portions.

Furthermore, although detailed description is omitted in the first and second embodiments, an electrostatic lens is disposed near the cathode 21 such that electrons $e^-$ emitted from the emitting surface of the cathode 21 travel in straight lines.

What is claimed is:

1. An electron beam emitter comprising:

an electron emission source capable of emitting electrons;

a vacuum chamber containing the electron emission source; and a transmission window that keeps airtightness of the vacuum chamber and is capable of transmitting the electrons from the electron emission source, the transmission window including a foil part and a grid part that supports the foil part, the foil part has multiple parts not supported by the grid part and the multiple parts comprise multiple transmission portions that transmit the electrons, the grid part comprises a non-transmission portion that does not transmit the electrons, the electron emission source including multiple emission portions that emit the electrons and a non-emission portion that does not emit the electrons, the multiple emission portions having a lower work function than the non-emission portion such that the emitted electrons from each emission portion of the multiple emission portions reach only each transmission portion of the multiple transmission portions, the non-emission portion being created so as to prevent the electrons from reaching the non-transmission portion, the vacuum chamber has an inner shell being connected to an edge of the transmission window, an outer shell being connected to a side of the transmission window and a space between the inner shell and the outer shell circulating a coolant.

2. The electron beam emitter according to claim 1, wherein the non-emission portion is patterned on the emission portions.

3. The electron beam emitter according to claim 1, wherein the emission portions are patterned on the non-emission portion.

4. The electron beam emitter according to claim 2, wherein the patterning is removal of a film by etching or mechanical scraping, the film being formed by CVD with a mask or coating, or vapor evaporation or coating.

5. The electron beam emitter according to claim 3, wherein the patterning is removal of a film by etching or mechanical scraping, the film being formed by CVD with a mask or coating, or vapor evaporation or coating.

6. The electron beam emitter according to claim 1, wherein the electron emission source is shaped like a disc.

7. The electron beam emitter according to claim 2, wherein the electron emission source is shaped like a disc.

8. The electron beam emitter according to claim 3, wherein the electron emission source is shaped like a disc.

9. The electron beam emitter according to claim 1, wherein the electron emission source is a wire.

10. The electron beam emitter according to claim 2, wherein the electron emission source is a wire.

11. The electron beam emitter according to claim 3, wherein the electron emission source is a wire.

12. The electron beam emitter according to claim 1, wherein the emission portions form multiple electron beams which are each matched to one of the plurality of transmission portions of the transmission window.

* * * * *